United States Patent [19]

Miyoshi et al.

[11] Patent Number: 4,661,174

[45] Date of Patent: Apr. 28, 1987

[54] NON-ORIENTED ELECTRICAL STEEL SHEET HAVING A LOW WATT LOSS AND A HIGH MAGNETIC FLUX DENSITY AND A PROCESS FOR PRODUCING THE SAME

[75] Inventors: Kunisuke Miyoshi; Yoshiaki Shimoyama; Takeshi Kubota, all of Kitakyushu, Japan

[73] Assignee: Nippon Steel Corporation, Tokyo, Japan

[21] Appl. No.: 614,139

[22] Filed: May 25, 1984

Related U.S. Application Data

[63] Continuation-in-part of Ser. No. 460,844, Jan. 25, 1983, abandoned.

[30] Foreign Application Priority Data

Jan. 27, 1982 [JP] Japan ..... 57-10211

[51] Int. Cl.[4] ..... H01F 1/04

[52] U.S. Cl. ..... 148/111; 148/307; 420/117; 420/121

[58] Field of Search ..... 148/31.55, 111, 110, 148/112, 113; 75/123 A, 123 B, 123 L

[56] References Cited

U.S. PATENT DOCUMENTS

| | | | |
|---|---|---|---|
| 3,940,299 | 4/1976 | Goto et al. . | |
| 4,046,602 | 9/1977 | Stanley | 148/111 |
| 4,204,890 | 5/1980 | Irie et al. | 148/111 |
| 4,293,336 | 10/1981 | Matsumura et al. | 75/124 |
| 4,338,143 | 7/1982 | Shimoyama et al. | 148/31.55 |

FOREIGN PATENT DOCUMENTS

| | | |
|---|---|---|
| 0019849 | 3/1980 | European Pat. Off. . |
| 2249957 | 4/1975 | France . |
| 54-163720 | 12/1979 | Japan . |
| 2005718A | 7/1979 | United Kingdom . |

*Primary Examiner*—John P. Sheehan

*Attorney, Agent, or Firm*—Cushman, Darby & Cushman

[57] ABSTRACT

In the production of non-oriented electrical steel sheets, it has been attempted to decrease the watt loss, e.g., by adding Sn to silicon steels, but in such a case the relationship between the watt loss and the magnetic flux density falls within the curves 1 and 1' in FIG. 1. The addition of boron is therefore unsatisfactory for meeting the recent demand for improving the magnetic properties of a non-oriented electrical steel sheet over those indicated by the curve 3.

In the present invention, the combined addition of Sn and B and/or sol. Al results in the development of (110) and (100) textures, which are desirable for the magnetic properties.

A non-oriented electrical steel sheet according to the present invention consists of:

at most 0.015% carbon,
0.3% to 2.0% silicon,
0.02% to 0.20% tin, and optionally
1.0% to 1.5% manganese, and (a) 0.005% to 0.10% acid-soluble aluminium,
at most 0.007% nitrogen,
at most 0.005% boron,
the weight ratio of the boron content/nitrogen content being from 0.5 to 1.5
balance iron and unavoidable impurities, or when manganese is present in said steel either, (b) 0.1% to 0.2% acid-soluble aluminium balance iron and unavoidable impurities, or (a).

4 Claims, 2 Drawing Figures

NON-ORIENTED ELECTRICAL STEEL SHEET HAVING A LOW WATT LOSS AND A HIGH MAGNETIC FLUX DENSITY AND A PROCESS FOR PRODUCING THE SAME

This is a continuation in part application of U.S. Ser. No. 460,844 filed Jan. 25, 1983, now abandoned.

The present invention relates to a non-oriented electrical steel sheet having a low watt loss and a high magnetic flux density and to process for producing the same.

A non-oriented electrical steel sheet is used as core material for electrical machinery and apparatuses, such as motors and transformers.

Recently, the demands for electrical machinery and apparatuses having enhanced characteristics have been increasing since, internationally, industry has been attempting to reduce electric power consumption and energy consumption in general. With respect to this, a low watt loss and a high magnetic flux density of the core material are indispensable for reducing electric power and energy consumption in electrical machinery and apparatuses. Also, recently, there have been very strong demands for the development of core material which can be used especially for medium- and small-sized electrical machinery and apparatuses and by which a low watt loss is attained, while at the same time maintaining the meritoriously high magnetic flux density and low cost of a non-oriented electrical steel sheet. In order to meet such demands, the magnetic properties of a non-oriented electrical steel sheet must be improved so that the watt loss in terms of $W_{15/50}$ is 4.5 w/kg or less, while the magnetic flux density in terms of $B_{50}$ is 1.71 Tesla or more.

As is well known, non-oriented electrical steel sheets are graded in accordance with the watt loss and magnetic flux density from S60- to S9-grades according to a JIS standard. In conventional high-grade non-oriented electrical steel sheets, the content of silicon, which appreciably increases resistivity, is high so as to decrease the watt loss. For instance, the silicon content of a grade S60 is virtually 0%, and the silicon content of S23, S18, and S9 grades is approximately 1.5%, approximately 2.0%, and approximately 3.0%, respectively. However, a high silicon content results in a decrease in the magnetic flux density.

The prior art is further described with reference to FIG. 1, which illustrates the relationships between the watt loss in terms of $W_{15/50}$ and the magnetic flux density $B_{50}$ with regard to conventional non-oriented electrical steel sheets as well as a non-oriented electrical steel sheet according to the present invention.

Figure 1:
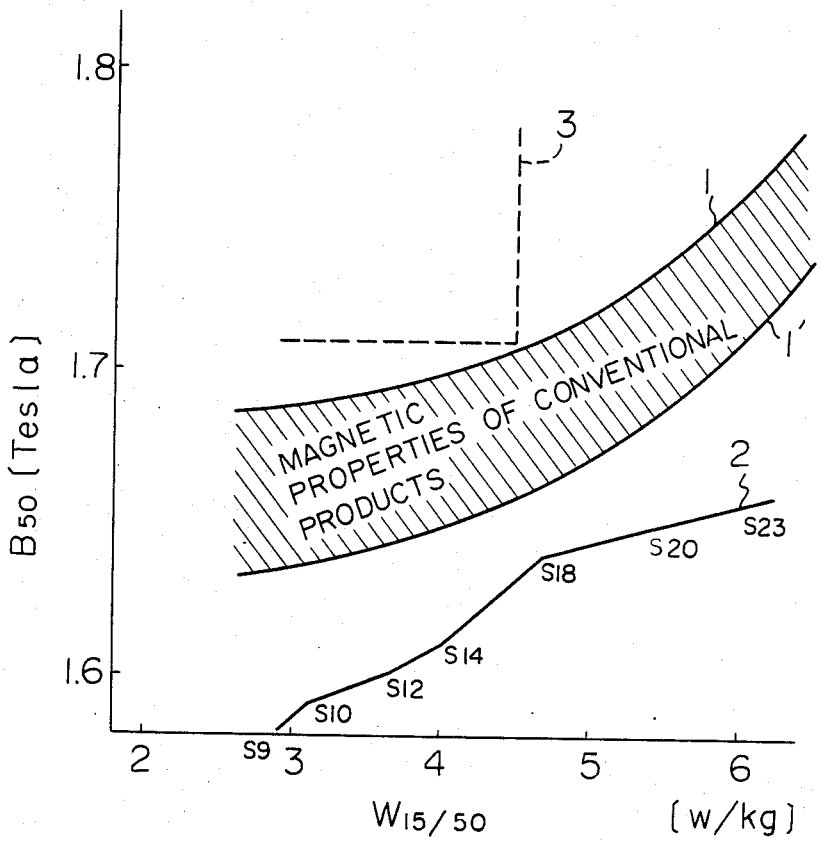
FIG. 1 is a graph illustrating the relationship between the watt loss and the magnetic flux density for conventional non-oriented electrical steels and non-oriented electrical steels according to the present invention.

The curves 1 and 1' in FIG. 1 represent the upper and lower limits of the $B_{50}$ and $W_{15/50}$ of conventional non-oriented electrical steel sheets, which are explained hereinafter, and illustrate that the watt loss is decreased in accordance with a decrease in the magnetic flux density. Line 2 in FIG. 1 is a line connecting the magnetic properties of non-oriented electrical steel sheets stipulated in JIS Standard C2552.

Attempts to improve the magnetic properties of a non-oriented electrical steel sheet, which do not rely on increasing the content of silicon, have previously been made. That is, these attempts include devising a steel chemistry, e.g., the addition of aluminum or boron to silicon steel, and decreasing the carbon or sulfur content, as well as improving production conditions, i.e., employing high-temperature annealing or a high reduction degree of cold rolling which is carried out before final annealing. For instance, Japanese Unexamined Patent Publication No. 54-163720/79 of the present applicant (Nippon Steel Corporation) discloses the addition of boron to silicon steel in such an amount that the weight ratio of the boron content/nitrogen content is maintained within a predetermined range. The growth of crystal grains during annealing is promoted due to the addition of boron, resulting in the economical production of a non-oriented electrical steel sheet having a low watt loss. Although the addition of boron disclosed in Japanese Unexamined Patent Publication No. 54-63720 results in a decrease in the watt loss, the relationship between the watt loss and the magnetic flux density falls within the curves 1 and 1' in FIG. 1. The addition of boron is therefore unsatisfactory for meeting the recent demands for improving the magnetic properties of a non-oriented electrical steel sheet as compared to the improvement of the magnetic properties indicated by the curve 3. U.S. Pat. No. 4,293,336 discloses the addition of tin to silicon steel so as to decrease the watt loss.

It is known from Japanese Unexamined Patent Publication No. 56-102520 to incorporate tin into silicon steel so as to reduce the watt loss of a non-oriented electrical steel sheet.

However, in order for tin to effectively decrease the watt loss, it is necessary to carry out slow cooling during the annealing of a hot-rolled steel strip or to employ a slow heating rate during final annealing, which procedure disadvantageously limits the process for producing a non-oriented electrical steel sheet. Although the addition of tin disclosed in Japanese Unexamined Patent Publication No. 56-102520 results in a decrease in the watt loss, the relationship between the watt loss and magnetic flux density falls within the curves 1 and 1' of FIG. 1. Thus, the addition of tin is unsatisfactory for meeting the above-mentioned recent demands for improving the magnetic properties of a non-oriented electrical steel sheet.

It is an object of the present invention to provide a non-oriented electrical steel sheet in which, in the production thereof, the watt loss in terms of $W_{15/50}$ is 4.5 w/kg at the highest and the magnetic flux density in terms of $B_{50}$ is 1.71 Tesla at the lowest, that is, the relationship between $W_{15/50}$ and $B_{50}$ is at least equal to the line 3 in FIG. 1.

It is another object of the present invention to provide a process for producing a non-oriented electrical steel sheet having the watt loss and magnetic flux density as specified above.

According to a discovery made by the present inventors, an increase in the magnetic flux density in non-oriented electrical steel sheets as compared with conventional non-oriented electrical steel sheets containing either tin or boron can be achieved by: adding boron to silicon steel in such an amount that the weight ratio of the boron content/nitrogen content is maintained within a predetermined range; adding tin to silicon steel in a small amount; and subjecting a hot-rolled steel strip to annealing or carrying out self-annealing by coiling a hot-rolled steel strip at a high temperature. That is, although the known addition of either boron or tin alone does not provide an increased magnetic flux density but only provides a decreased watt loss, the combined addition of boron and tin can simultaneously attain both a low watt loss and a high magnetic flux density.

According to another discovery made by the present inventors, the boron can be totally or partially replaced with aluminum when the content of manganese in a silicon steel is appreciably high.

According to yet another discovery made by the present inventors, when silicon steel contains both boron and tin, the above-mentioned annealing of a hot-rolled steel strip, can be carried out continuously in a short period of time.

The present invention was completed based on this discovery.

A non-oriented electrical steel sheet according to the present invention having a low watt loss and a high magnetic flux density consists of:

at most 0.015% carbon,
0.3% to 2.0% silicon,
0.02% to 0.20% tin, and optionally more than 1.0% to 1.5% manganese, and I. (a) 0.005% to 0.10% acid-soluble aluminium (hereinafter referred to as sol. Al)
at most 0.007% nitrogen,
at most 0.005% boron,
the weight ratio of the boron content/nitrogen content being from 0.5 to 1.5
balance iron and unavoidable impurities, or II. when manganese is present in said steel either,
(b) 0.1% to 0.2% acid-soluble aluminium
balance iron and unavoidable impurities,
or (a), said steel sheet produced by annealing a hot-rolled steel strip.

The non-oriented electrical steel sheet having the composition (a) and not having more than 1.0% manganese is hereinafter referred to as a Sn-B non-oriented electrical steel sheet.

A non-oriented electrical steel sheet according to the present invention having a composition other than that of the Sn-B non-oriented electrical steel sheet is hereinafter referred to as a Sn-Al(B) non-oriented electrical steel sheet.

A process for producing the Sn-B non-oriented electrical steel sheet or the Sn-Al(B) non-oriented electrical steel sheet according to the present invention successively comprises the steps of: hot-rolling a silicon steel having the composition as specified above; annealing the hot-rolled steel strip; cold-rolling the hot-rolled steel strip once or twice or more with intermediate annealing; and continuously annealing the cold-rolled steel strip. The annealing of the hot-rolled steel strip may be carried out by means of coiling the hot-rolled steel strip at a temperature of 700° C. at the lowest and then self-annealing the coiled hot-rolled steel strip. That is, instead of carrying out usual annealing, such as hot-coil annealing, after the steel is hot-rolled, annealing of the hot-rolled strip may be completed in the hot-rolling step. When the annealing of a hot-rolled strip is carried out after the hotrolling step, the annealing temperature is 850° C. at the lowest.

First, the Sn-B non-oriented electrical steel sheet is described with regard to how tin and boron synergistically improve the magnetic properties thereof. When a non-oriented electrical steel sheet contains boron only, the boron fixes the nitrogen, which is detrimental to the magnetic properties, and boron nitrides precipitate in the crystal grains. When a non-oriented electrical steel sheet contains tin only, the tin segregates at the grain boundaries and suppresses during recrystallization the generation of a (111) orientation, which orientation is detrimental to the magnetic properties thereof.

In the Sn-B non-oriented electrical steel sheet, the segregated tin suppresses the initiation of recrystallization at the grain boundaries and promotes the initiation of recrystallization in the crystal grains. In addition, the boron nitrides which are precipitated in the crystal grains behave as nuclei during recrystallization and promote the generation of (110) and (100) textures, which are advantageous for the magnetic properties thereof. Therefore, the magnetic properties of the Sn-B non-oriented electrical steel sheet are considerably improved over the magnetic properties of a non-oriented electrical steel sheet containing either boron or tin alone.

Second, the Sn-Al(B) non-oriented electrical steel sheet is described with regard to how manganese, tin, and aluminum or boron synergistically improve the magnetic properties thereof. Manganese lowers the recrystallization temperature and substantially facilitates recrystallization. When the Sn-Al(B) non-oriented electrical steel sheet contains boron, the synergistic effect of tin and boron, which is explained with reference to the Sn-B non-oriented electrical steel sheet, is also attained and promoted since manganese substantially promotes recrystallization.

When the Sn-Al(B) non-oriented electrical steel sheet contains an appreciable amount of sol. Al, i.e., more than from 0.1% to 0.2%, an improvement in the magnetic properties is attained by even partially or totally replacing boron with sol. Al. Aluminum added to a silicon steel and alloyed in the silicon steel as sol. Al in an appreciable amount prevents the precipitation of AlN, which is so fine that growth of crystals is prevented during the annealing and is hence detrimental to the magnetic properties thereof. This AlN is hereinafter referred to as the fine AlN. In addition, aluminum increases the resistivity and decreases the watt loss of silicon steels. Tin segregates at the grain boundaries and suppresses during recrystallization the generation of a (111) orientation, which is detrimental to the magnetic properties of a silicon steel. Manganese, sol. Al, and tin, which are advantageous for the magnetic properties, as will be understood from the above descritpion, synergistically promote the generation of (110) and (100) orientations so that the Sn-Al(B) non-oriented electrical steel sheet has predominantly (110) and (100) textures.

It should be noted with regard to nitrogen and sol. Al that: nitrogen does not form compounds or precipitates which behave as nuclei during recrystallization; the fine AlN, which is detrimental to the magnetic properties of a silicon steel, is not formed due to an appreciable sol. Al content of the Sn-A(B) non-oriented electrical steel sheet; and sol. Al not only removes the detrimental effects of nitrogen but also increases resistivity, thereby decreasing the watt loss.

As will have been understood from the descriptions hereinabove, the concept which is common to both the Sn-B non-oriented electrical steel sheet and the Sn-Al(B) non-oriented electrical steel sheet is the controlling of recrystallization so that it is advantageous with regard to the magnetic properties thereof. When this concept is explained in more metallurgical terms, it can be said that the combined addition of tin and boron and/or sol. Al renders recrystallization liable to occur predominantly in the crystal grains, and (110) and (100) textures which are desirable for the magnetic properties are formed during recrystallization. On the other hand, the conventional addition of tin only and the addition of boron and/or sol. Al only are not very effective for suppressing the formation of a (111) texture, which is detrimental to the magnetic properties of a non-oriented electrical steel sheet.

The compositions of the Sn-B non-oriented electrical steel sheet and the Sn-B(Al) non-oriented electrical steel sheet are now described.

Carbon is a harmful element which increases the watt loss. Therefore, a low carbon content, i.e., 0.015% or less, is desirable so as to reduce the watt loss and prevent deterioration of the magnetic properties due to aging or so-called magnetic aging. A carbon content of not more than 0.005% is desirable for promoting the synergistic effects which are attained by the combined addition of tin and boron and/or sol. Al.

Silicon increases the resistivity of and decreases the watt loss of a steel, as is well known. The silicon content which is effective for decreasing the watt loss is 0.3% at the lowest. However, when the silicon content is more than 2.0%, the rolling workability of silicon steel is impaired and the non-oriented electrical steel sheet becomes expensive.

Aluminum is necessary for deoxidizing steels. A sol. Al content of 0.005% is necessary for effectively deoxidizing silicon steels.

In the case of the Sn-B non-oriented electrical steel sheet containing boron, the maximum content of sol. Al should be so controlled that the sol. Al does not excessively fix the nitrogen. If the sol. Al content is more than 0.1%, the sol. Al fixes the nitrogen excessively, and, thus, the amount of solute boron is increased, with the result that the watt loss is increased and the magnetic flux density is decreased. In other words, when the sol. Al content is more than 0.1%, the sol. Al renders the boron ineffective for improving the magnetic properties of the non-oriented electrical steel sheet.

In the case of the Sn-Al(B) non-oriented electrical steel sheet, boron can be partially or totally replaced with sol. Al as described above. If boron is totally replaced with sol. Al, the sol. Al content must be more than 0.1% so as to prevent the precipitation of the fine AlN. If boron is partially replaced with sol. Al and if the content of the sol. Al is 0.1% at the highest, the weight ratio of the boron content/nitrogen content should be from 0.5 to 1.5 ($0.5 \leqq B/N \leqq 1.5$). When the content of sol. Al is more than 0.20%, the magnetic flux density is low.

Boron together with tin or together with both manganese and tin synergistically improves the magnetic properties of a non-oriented electrical steel sheet. In order for boron to have a synergistic effect, the weight ratio of the boron content/nitrogen content must be from 0.5 to 1.5. If the weight ratio is less than 0.5, it is difficult to eliminate the detrimental effect of nitrogen. On the other hand, when such ratio is more than 1.5, the amount of solute boron is so increased that the magnetic properties of the non-oriented electrical steel sheet cannot be improved. The boron content must be 0.005% at the highest so as to prevent the formation of cracks on slabs during hot-rolling.

Tin together with boron or together with both manganese and sol. Al synergistically improves the magnetic properties of the non-oriented electrical steel sheet. In order for tin to have a synergistic effect, the content of tin must be 0.02% at the lowest. However, when the tin content is more than 0.20%, the effect of tin is saturated and the production cost is increased.

Manganese is conventionally used to enhance the magnetic properties of a non-oriented electrical steel sheet because manganese is liable to form nonmetallic inclusions, such as sulfides and oxides. However, it is possible to use manganese to enhance the magnetic properties of an electrical steel sheet since the steelmaking technique is advanced enough so that high-purity steels can be produced. According to a discovery made by the present invetors, manganese is effective for developing (100) and (110) textures, which textures result in desirable magnetic properties, and for suppressing a (111) texture, which texture is detrimental to the magnetic properties thereof. In the Sn-Al(B) non-oriented electrical steel sheet, the manganese content is more than 1.0% so as to promote the development of (100) and (110) textures. And, since manganese lowers the ferrite-austenite transformation temperature, if the manganese content is more than 1.5%, ferrite-austenite transformation is likely to occur during the annealing of a hot-rolled strip, thereby rendering the manganese ineffective for improving the texture and the magnetic properties. The manganese content in the Sn-B non-oriented electrical steel sheet is not specified and may be less than 1.0%, e.g., approximately 0.3%.

The elements other than those described above are iron and unavoidable impurities.

The Sn-B non-oriented electrical st.eel sheet and a process for producing such a sheet are further described with reference to experiments carried out by the present inventors.

In the experiments, four hot-rolled steel strips having the compositions as given in Table 1-1 below were subjected to each of the production steps given in Table 1-2 below. The magnetic properties obtained are given in Table 1-3 below.

TABLE 1-1

| | Composition of Steels (%) | | | | | | |
|---|---|---|---|---|---|---|---|
| No. | C | Si | S | Sol. Al | B | N | Sn |
| 1 | 0.003 | 1.50 | 0.005 | 0.023 | 0.0021 | 0.0018 | 0.065 |
| 2 | 0.003 | 1.51 | 0.004 | 0.022 | 0.0022 | 0.0017 | — |
| 3 | 0.003 | 1.38 | 0.004 | 0.260 | — | 0.0018 | — |
| 4 | 0.003 | 1.40 | 0.005 | 0.255 | — | 0.0018 | 0.070 |

TABLE 1-2

| | | | | |
|---|---|---|---|---|
| Process A | Hot-Rolled Strip | Annealing 900° C. × 2 min. | Cold-Rolling 0.5 mm | Continuous Annealing 900° C. × 20" |
| Process B | Hot-Rolled Strip | — | Cold-Rolling 0.5 mm | Continuous Annealing 900° C. × 20" |

TABLE 1-3

| Composition & Process | Magnetic Properties $W_{15/50}$ W/kg | $B_{50}$ Tesla | Composition & Process | $W_{15/50}$ W/kg | $B_{50}$ Tesla |
|---|---|---|---|---|---|
| 1A | 3.58 | 1.754 | 1B | 4.01 | 1.701 |
| 2A | 3.84 | 1.684 | 2B | 4.32 | 1.663 |
| 3A | 3.98 | 1.686 | 3B | 4.36 | 1.673 |
| 4A | 3.67 | 1.704 | 4B | 4.25 | 1.686 |

As can be seen from Table 1-3, only the Sn-B non-oriented electrical steel sheet, i.e., 1A, had a low watt loss and a high magnetic flux density. The other non-oriented electrical steel sheets in which at least either the combined addition of tin and boron or the annealing of a hot-rolled strip was not satisfied had a high watt loss and a low magnetic flux density.

The process for producing the Sn-B non-oriented electrical steel sheet and the Sn-Al(B) non-oriented electrical steel sheet is now described.

Steels having the composition as described above are melted in a converter, an electric furnace, or the like and are continuously cast or cast as an ingot, followed by rough-rolling to obtain a slab.

The slab is hot-rolled at a predetermined temperature so as to produce a hot-rolled steel strip. Annealing of a hot-rolled steel strip can improve the texture of the strip, thereby enhancing the magnetic properties thereof as compared with those without annealing of a hot-rolled steel strip. If the hot-rolled steel strip is annealed at a temperature of less than 850° C., the annealing is not very effective for improving the texture of the strip.

Annealing of the hot-rolled steel strip may be carried out by means of self-annealing, in which the strip is annealed by the heat retained therein. Self-annealing can be attained by coiling the hot-rolled steel strip at a temperature of 700° C. at the lowest. If the coiling temperature is less than 700° C., fine precipitates form during subsequent annealing, i.e., the annealing of the hot-rolled steel strip, and suppress the growth of crystal grains.

A coiled hot-rolled steel strip is advantageous covered with a heat-insulation cover which reduces the amount of heat which radiates from the strip. Evidently, if the coiling temperature is less than 700° C., the hot-rolled steel strip is subsequently annealed, e.g., by means of batch annealing or continuous annealing. Since the magnetic properties obtained by both the rapid-heating rate and the rapid-cooling rate of annealing are excellent, continuous annealing is advisable for annealing the hot-rolled steel strip.

The hot-rolled steel strip is then cold-rolled once or twice or more with intermediate annealing, thereby obtaining a final thickness. Intermediate annealing is carried out between successive cold-rollings.

Finishing annealing of a cold-rolled steel strip is then carried out. Slow heating during finishing annealing is not very advantageous for the magnetic properties since the combined addition of tin and boron and/or sol. Al changes the influences of the heating rate on the magnetic properties in such a manner that rapid heating is rather desirable for the magnetic properties. The annealing temperature is varied in accordance with the magnetic properties to be attained. Since continuous finishing annealing is more advisable than batch finishing annealing, the production efficiency of the Sn-B non-oriented electrical steel sheet and Sn-Al(B) non-oriented electrical steel sheet is high, which is one of the synergistic effects attained by the combined addition of tin and boron and/or sol. Al.

Although the process for producing the Sn-B non-oriented electrical steel sheet and the Sn-Al(B) non-oriented electrical steel sheet is completed at finishing annealing, such sheets may be further subjected to stress-relief annealing or skin pass rolling. The reduction rate (draft) at skin pass rolling depends on the intermediate annealing temperature. Preferably, the reduction rate at skin pass rolling is from 2% to 10%. The skin pass-rolled steel strip is then subjected to blanking to obtain a predetermined sheet section and is then stress-relief annealed. In this case, a so-called semi-processed non-oriented electrical steel sheet is produced. When the reduction rate at skin pass rolling is less than 2%, stress-relief annealing is ineffective for improving the watt loss. On the other hand, a reduction rate at skin pass rolling of more than 10% results in deterioration of the magnetic properties.

The present invention is described now by way of examples.

EXAMPLE 1

Non-oriented electrical steel sheets were produced under the conditions of the process for treating steels given in Table 2.

TABLE 2

| Steel Nos. | Composition of Slabs C | Si | Mn | S | Sol Al | B | Sn | N | B/N | Process Conditions CT | HCA | T | FA | Magnetic Properties FA $W_{15/50}$ (W/kg) | $B_{50}$ (Tesla) | Remarks |
|---|---|---|---|---|---|---|---|---|---|---|---|---|---|---|---|---|
| 5 | 0.003 | 0.46 | 0.26 | 0.006 | 0.022 | 0.0022 | 0.07 | 0.0019 | 1.2 | 780° C. | — | 0.5 mm | 875° C. × 20 sec. | 4.41 | 1.79 | Invention |
| 6 | 0.003 | 0.47 | 0.24 | 0.007 | 0.023 | 0.0023 | 0.07 | 0.0020 | 1.2 | 650° C. | — | 0.5 mm | 875° C. × 20 sec. | 6.88 | 1.75 | Control |
| 7 | 0.003 | 0.52 | 0.31 | 0.006 | 0.031 | 0.0024 | — | 0.0021 | 1.1 | 790° C. | — | 0.5 mm | 900° C. × 60 sec. | 5.03 | 1.76 | Control |
| 8 | 0.003 | 1.13 | 0.28 | 0.006 | 0.025 | 0.0024 | 0.06 | 0.0020 | 1.2 | 800° C. | — | 0.5 mm | 900° C. × 20 sec. | 3.98 | 1.77 | Invention |
| 9 | 0.003 | 1.12 | 0.22 | 0.005 | 0.023 | 0.0023 | 0.06 | 0.0021 | 1.1 | 650° C. | — | 0.5 mm | 900° C. × 20 sec. | 4.72 | 1.69 | Control |
| 10 | 0.003 | 1.09 | 0.26 | 0.006 | 0.270 | — | 0.05 | 0.0019 | — | 650° C. | 900° C. × 2 min. | 0.5 mm | 900° C. × 30 sec. | 4.52 | 1.70 | Control |
| 11 | 0.003 | 1.67 | 0.27 | 0.004 | 0.023 | 0.0024 | 0.07 | 0.0021 | 1.1 | 670° C. | 925° C. × 2 min. | 0.5 mm | 900° C. × 20 sec. | 3.38 | 1.75 | Invention |
| 12 | 0.002 | 1.69 | 0.30 | 0.004 | 0.022 | 0.0025 | 0.07 | 0.0023 | 1.1 | 660° C. | — | 0.5 mm | 900° C. × 20 sec. | 3.98 | 1.70 | Control |
| 13 | 0.003 | 1.72 | 0.22 | 0.005 | 0.025 | 0.0021 | — | 0.0019 | 1.1 | 660° C. | 925° C. × | 0.5 mm | 900° C. × | 3.76 | 1.68 | Control |

TABLE 2-continued

| Steel Nos. | Composition of Slabs C | Si | Mn | S | Sol Al | B | Sn | N | B/N | Process Conditions CT | HCA | T | FA | Magnetic Properties FA $W_{15/50}$ (W/kg) | $B_{50}$ (Tesla) | Remarks |
|---|---|---|---|---|---|---|---|---|---|---|---|---|---|---|---|---|
| 14 | 0.003 | 0.51 | 1.31 | 0.004 | 0.022 | 0.0024 | 0.07 | 0.0023 | 1.0 | 780° C. | 2 min. — | 0.5 mm | 20 sec. 875° C. × 20 sec. | 3.95 | 1.81 | Invention |
| 15 | 0.003 | 0.50 | 1.30 | 0.004 | 0.18 | — | 0.06 | 0.0023 | — | 780° C. | — | 0.5 mm | 875° C. × 20 sec. | 3.89 | 1.81 | Invention |

CT . . . Coiling temperature
SA . . . Self-annealing
HCA . . . Hot-coil annealing
FA . . . Finishing annealing As can be understood from Table 2, both a low watt loss and a high magnetic flux density are attained when steels: contain both boron and tin or have high manganese and sol. Al contents and contain tin, and, at the same time, are self-annealed or annealed after the hot-rolling step.

EXAMPLE 2

Steel Nos. 5, 6, 7, 14, and 15 were subjected to the same production procedure as in Example 1 except that virtually 0.5 mm-thick cold-rolled steel strips were continuously annealed at 750° C. for a period of 60 seconds (1 minute) and then were skin pass-rolled at a reduction rate of 4%. An Epstein specimen was cut from the skin pass-rolled strip and the magnetic properties were measured after carrying out stress-relief annealing at 790° C. for a period of 1 hour (60 minutes).

The magnetic properties are given in Table 3.

TABLE 3

| Steel Nos. | Magnetic Properties of Semi-Processed Non-Oriented Electrical Steel Sheets $W_{15/50}$ (W/kg) | $B_{50}$ (Tesla) |
|---|---|---|
| 5 | 3.95 | 1.75 |
| 6 | 6.23 | 1.73 |
| 7 | 4.53 | 1.73 |
| 14 | 2.92 | 1.79 |
| 15 | 2.89 | 1.78 |

EXAMPLE 3

Steels having the composition as given in Table 4 below were subjected to continuously annealing hot-rolling, coiling at 750° C., annealing at 900° C. for a period of 2 minutes, cold-rolling to obtain 0.50 mm-thick strips, finishing annealing at 850° C. for a period of 1 minute, skin pass rolling with a reduction degree of 6%; and stress-relief annealing at 790° C. for a period of 1 hour in a 100% $N_2$ atmosphere.

TABLE 4

| No. | Composition of Steels (wt. %) C | Si | Mn | S | Sol. Al | Sn |
|---|---|---|---|---|---|---|
| 16 | 0.004 | 0.49 | 0.26 | 0.003 | 0.17 | — |
| 17 | 0.004 | 0.51 | 0.50 | 0.002 | 0.16 | — |
| 18 | 0.003 | 0.46 | 0.77 | 0.002 | 0.17 | — |
| 19 | 0.004 | 0.47 | 1.03 | 0.003 | 0.18 | — |
| 20 | 0.003 | 0.53 | 1.27 | 0.002 | 0.19 | — |
| 21 | 0.003 | 0.51 | 1.46 | 0.003 | 0.18 | — |
| 22 | 0.004 | 0.50 | 0.28 | 0.003 | 0.17 | 0.09 |

TABLE 4-continued

| No. | Composition of Steels (wt. %) C | Si | Mn | S | Sol. Al | Sn |
|---|---|---|---|---|---|---|
| 23 | 0.003 | 0.49 | 0.52 | 0.003 | 0.20 | 0.10 |
| 24 | 0.003 | 0.49 | 0.79 | 0.003 | 0.15 | 0.09 |
| 25 | 0.003 | 0.51 | 1.04 | 0.002 | 0.18 | 0.11 |
| 26 | 0.004 | 0.47 | 1.27 | 0.002 | 0.16 | 0.10 |
| 27 | 0.003 | 0.49 | 1.45 | 0.003 | 0.18 | 0.09 |

Figure 2:
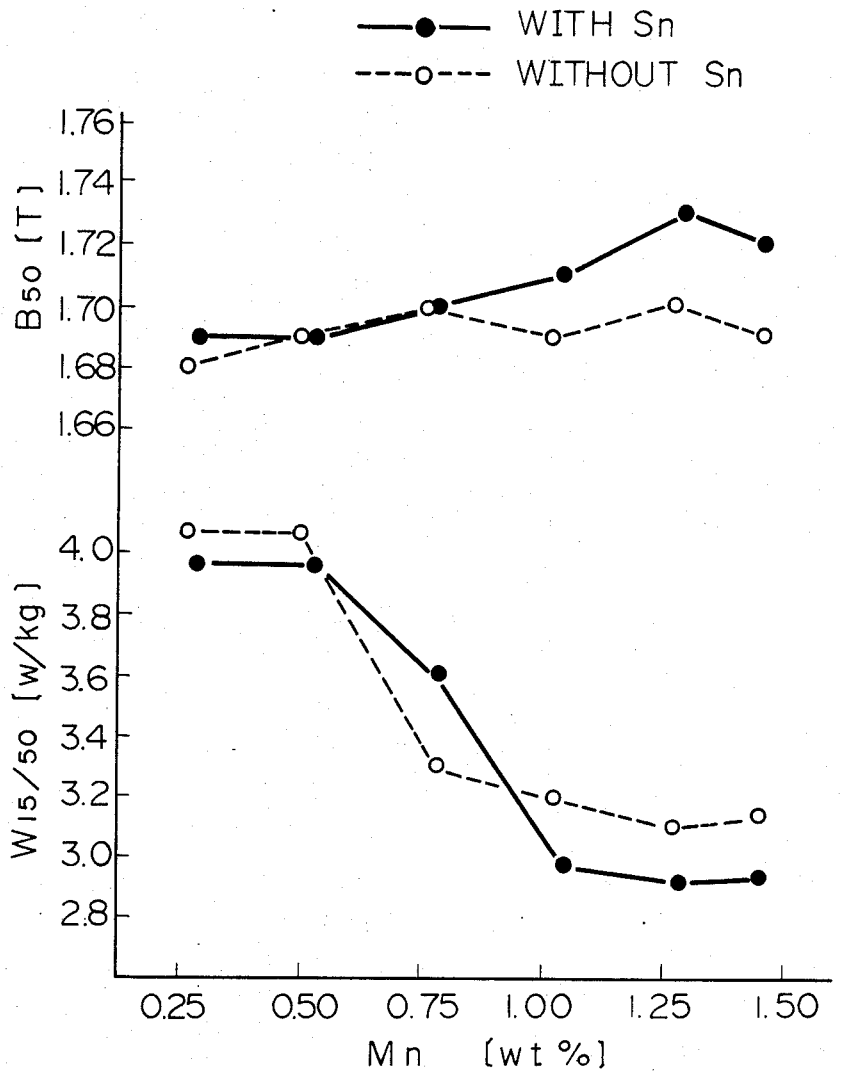
FIG. 2 is a graph illustrating the watt loss and magnetic flux density as a function of manganese content for non-oriented electrtical steels with and without tin.

The dependence of the magnetic properties manganese content is illustrated in FIG. 2. As will be understood from FIG. 2, a manganese content of more than 1% is effective for improving the magnetic properties of non-oriented electrical steel sheets containing tin and an acid soluble Al at a content of 0.1–0.2% and a decrease in the watt-loss and an increase in the magnetic flux density are simultaneously attained.

We claim:

1. A process for producing a non-oriented electrical steel exhibiting a watt loss ($W_{15/50}$) of at most 4.5 W/kg and a magnetic flux density $B_{50}$ of at least 1.71 Tesla, said steel consisting essentially of:

| | |
|---|---|
| carbon | at most 0.015% |
| silicon | 0.3% to 2.0% |
| tin | 0.02% to 0.20% |
| acid-soluble aluminum | 0.005% to 0.10% |
| nitrogen | at most 0.007% |
| boron | at most 0.005% |

provided that the weight ratio of the boron to nitrogen is from 0.5 to 1.5, balance iron and unavoidable impurities, said process comprising the successive steps of:

(1) hot-rolling a silicon steel having the composition as specified above;

(2) annealing the hot-rolled steel strip;

(3) cold-rolling the annealed steel strip at least once with an intermediate annealing; and (4) continuously annealing the cold-rolled steel strip.

2. A process according to claim 1, wherein said annealing of the hot-rolled steel strip is carried out by means of coiling the hot-roll strip at a temperature of at least 700° C. and self-annealing the coiled hot-rolled steel strip.

3. A process according to claim 1, wherein said annealing of step (2) is carried out at a temperature of at least 850° C.

4. A process according to claim 1, wherein said continuously annealed cold-rolled steel strip of step (4) is subjected to an additional step of:

(5) skin pass rolling at a reduction rate of from 2% to 10%.

* * * * *